US008485377B2

(12) United States Patent
McDonald et al.

(10) Patent No.: US 8,485,377 B2
(45) Date of Patent: Jul. 16, 2013

(54) MODULAR CONTAINER ASSEMBLY

(75) Inventors: Sandy McDonald, Ripon, WI (US); Nicholas Harry Zompolas, Fond du lac, WI (US)

(73) Assignee: Spartech Corporation, St. Louis, MO (US)

( * ) Notice: Subject to any disclaimer, the term of this patent is extended or adjusted under 35 U.S.C. 154(b) by 198 days.

(21) Appl. No.: 12/912,462

(22) Filed: Oct. 26, 2010

(65) Prior Publication Data

US 2012/0097673 A1 Apr. 26, 2012

(51) Int. Cl.
*B65D 21/02* (2006.01)
*A47G 19/00* (2006.01)

(52) U.S. Cl.
USPC ..... 220/23.4; 220/23.83

(58) Field of Classification Search
USPC ..... 220/23.2, 23.4, 23.83, 23.87–23.89, 220/528, 737; 206/562, 563
See application file for complete search history.

(56) References Cited

U.S. PATENT DOCUMENTS

| | | | | |
|---|---|---|---|---|
| 3,103,303 | A * | 9/1963 | Lynchey | 294/172 |
| 3,390,766 | A * | 7/1968 | Stockdale | 206/427 |
| 3,501,044 | A * | 3/1970 | Stone | 220/23.4 |
| 3,751,098 | A * | 8/1973 | Owen | 294/87.2 |
| 4,314,650 | A * | 2/1982 | Cillario | 220/23.83 |
| 4,483,455 | A | 11/1984 | Prophet, Jr. et al. | |
| 4,925,047 | A | 5/1990 | Valentine et al. | |
| 4,966,296 | A | 10/1990 | Farrell | |
| 5,175,404 | A | 12/1992 | Andreas et al. | |
| 5,317,119 | A | 5/1994 | Ayres | |
| 5,326,021 | A | 7/1994 | Farrell et al. | |
| 5,372,274 | A | 12/1994 | Freedland | |
| 5,419,486 | A | 5/1995 | Bennett et al. | |
| 5,609,282 | A * | 3/1997 | Melanson | 224/576 |
| 5,690,245 | A | 11/1997 | Jenkins | |
| 5,727,679 | A | 3/1998 | Newarski | |
| 5,950,838 | A * | 9/1999 | Fletcher et al. | 206/775 |
| 6,509,047 | B2 | 1/2003 | Edomwonyi | |
| 7,019,271 | B2 | 3/2006 | Wnek et al. | |
| 7,205,016 | B2 | 4/2007 | Garwood | |
| 7,415,428 | B2 | 8/2008 | Garwood | |

FOREIGN PATENT DOCUMENTS

EP 179005 A1 * 4/1986

OTHER PUBLICATIONS

Machine Translation of EP 0179005 A1.*

* cited by examiner

*Primary Examiner* — Harry Grosso
(74) *Attorney, Agent, or Firm* — Armstrong Teasdale LLP

(57) ABSTRACT

A modular container assembly is provided for packaging a plurality of products. The modular container assembly includes a frame and a portable container. The frame includes a plurality of edge portions that define a plurality of openings. The container includes a sidewall that defines a cavity. The container is sealable at a rim portion of the sidewall to retain a product within the cavity. The container is configured to fit within a first opening of the plurality of openings such that the rim portion is removably coupled to a first edge portion of the plurality of edge portions.

16 Claims, 10 Drawing Sheets

MODULAR CONTAINER ASSEMBLY

BACKGROUND OF THE INVENTION

The subject matter described herein relates generally to the packaging of products. More particularly, the subject matter described herein relates to a modular container assembly for packaging a plurality of products.

Container systems are known to contain at least one product within a cavity. Examples of products contained with such known container systems include food products, cosmetics, adhesives, and medical/surgical tools. Typically, container systems are uniquely configured for each storage and/or application requirement. Meeting such unique storage or application requirements can be expensive in terms of capital investment for tooling to fabricate the container as well as drive inventory costs.

With at least some known container system applications, once a product is stored therein, the system may be subjected to further processing. For example, known container systems may be filled with a first product, and then subsequently heated, cooled, sealed, and/or stored to further process and/or treat the first product. When such known container systems are filled with a second product, the second product mixes with the first product and, thus, is subject to similar processes, treatments, and/or environments as the first product, which may not be acceptable.

To separate one product from another product, at least some known container systems include a plurality of sidewalls that define a plurality of cavities, wherein each of the cavities contains a separate product. Each sidewall typically is formed from the same material as the other sidewalls, and therefore, the material used to form the sidewalls is selected so as to accommodate the processing requirements for all the products stored in the container system. As a result, if one of the sidewalls requires use of more expensive material than the other sidewalls, even the other sidewalls are fabricated from the more expensive material, which adversely impacts the overall cost of the container system.

In addition to material selection, in at least some applications, the shape of at least one sidewall of the container system is independent of the shape of the other sidewalls. Known systems generally do not provide for selection of independent sidewall shapes, which is a constraint on the types of products that may be stored as well as product combinations.

BRIEF DESCRIPTION OF THE INVENTION

In one aspect, a modular container assembly is provided. The modular container assembly includes a frame and a first portable container. The frame includes a plurality of edge portions that define a plurality of openings. The first container includes a sidewall that defines a cavity. The first container is sealable at a rim portion of the sidewall to retain a product within the cavity. The first container is configured to fit within a first opening of the plurality of openings such that the rim portion is removably coupled to a first edge portion of the plurality of edge portions.

In another aspect, a method is provided for packaging a product in a modular container assembly. The modular container assembly includes a frame and a first portable container. The frame includes a plurality of edge portions that define a plurality of openings. The first container includes a sidewall that defines a cavity. The sidewall includes a rim portion. The method includes at least partially filling the first container with the product and sealing the container at the rim portion to retain the product within the cavity. The first container is received within a first opening of the plurality of openings, and the rim portion is removably coupled to a first edge portion of the plurality of edge portions.

In yet another aspect, a portable container is provided for use with a modular container assembly including a frame that includes a plurality of edge portions that define a plurality of openings. The container includes a base and a sidewall extending upward from the base to define a cavity. The container is sealable at a rim portion of the sidewall to retain a product within the cavity. The container is configured to fit within a first opening of the plurality of openings such that the rim portion is removably coupled to a first edge portion of the plurality of edge portions.

DETAILED DESCRIPTION OF THE INVENTION

Set forth below is a description of methods and systems for packaging products. More particularly, a modular container assembly for packaging a plurality of products is described below.

For example, in one embodiment, a container assembly includes a modular set of containers and frames. A first container includes a first product, and a second container includes a second product that is complementary to the first product. For example, in one embodiment, the containers may contain food products such as, without limitation, fruit and yogurt, chips and dip, or soup and crackers. In another embodiment, the containers may contain non-food products such as, without limitation, nuts and bolts or medical equipment. Additionally or alternatively, a first container may contain a shelf-stable product, and a second container may contain a non-shelf stable product.

In one embodiment described below, the frame includes an edge portion that has an undercut, and at least one container includes a rim portion that has a flange. The flange is substantially complementary to the undercut such that the flange engages with the undercut to couple the container to the frame. The modular container assembly can have many different configurations and can be fabricated from many different materials.

As used herein, an element or step recited in the singular and proceeded with the word "a" or "an" should be understood as not excluding plural elements or steps unless such exclusion is explicitly recited. Furthermore, references to "one embodiment" of the present invention are not intended to be interpreted as excluding the existence of additional embodiments that also incorporate the recited features.

Figure 1:
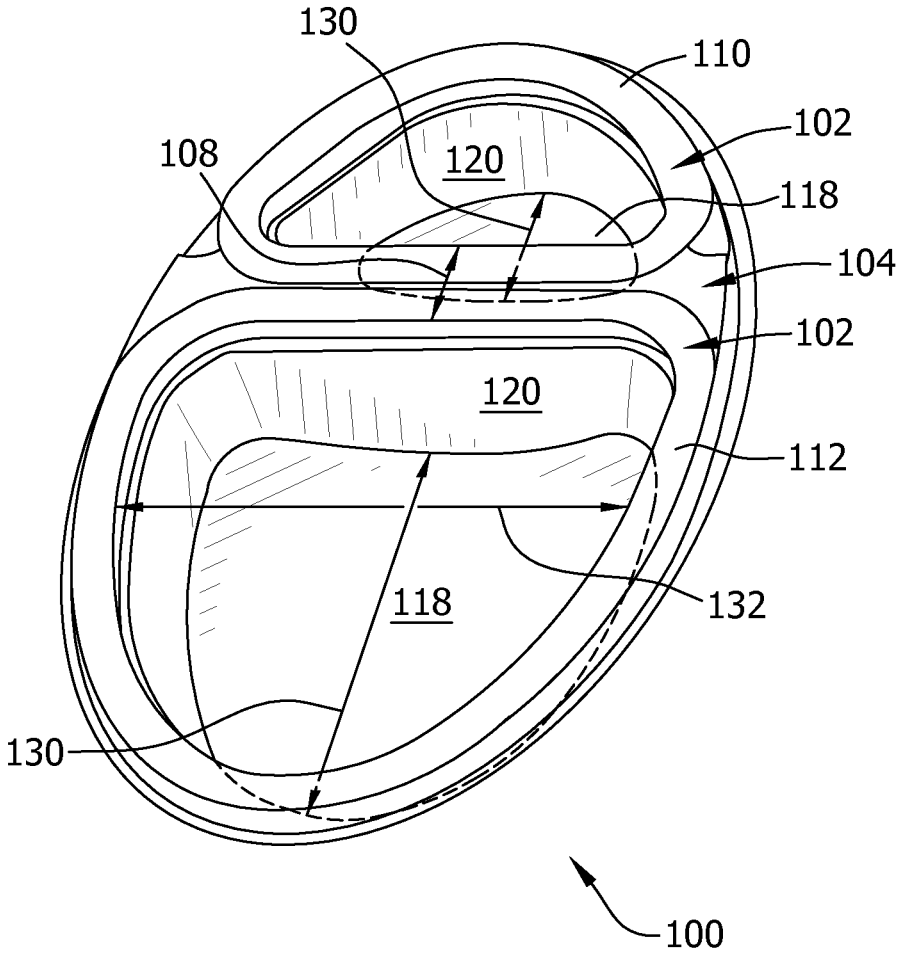
FIG. 1 is a perspective view of an exemplary modular container assembly.
Figure 2:
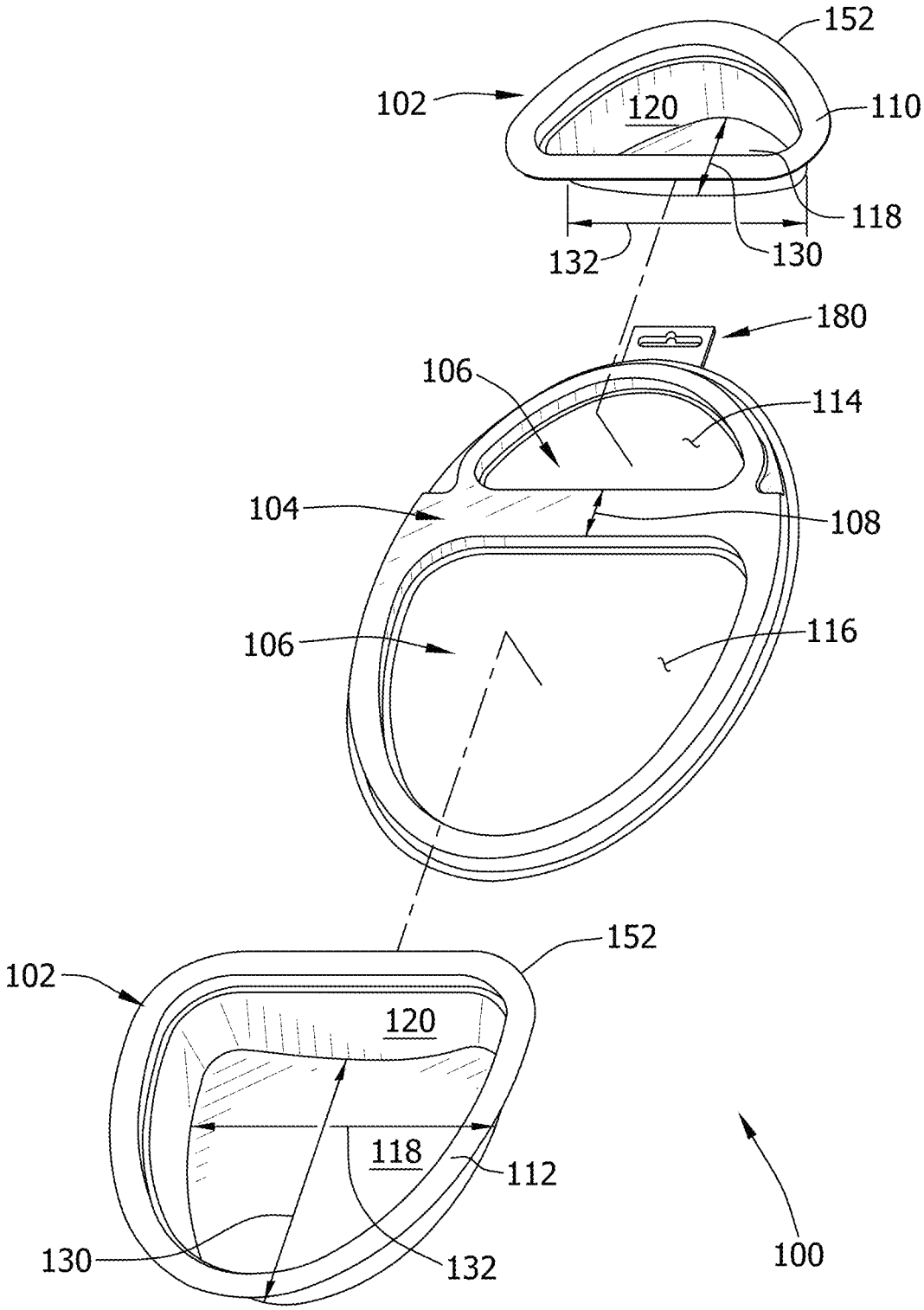
FIG. 2 is an exploded perspective view of the modular container assembly shown in FIG. 1.
Figure 3:
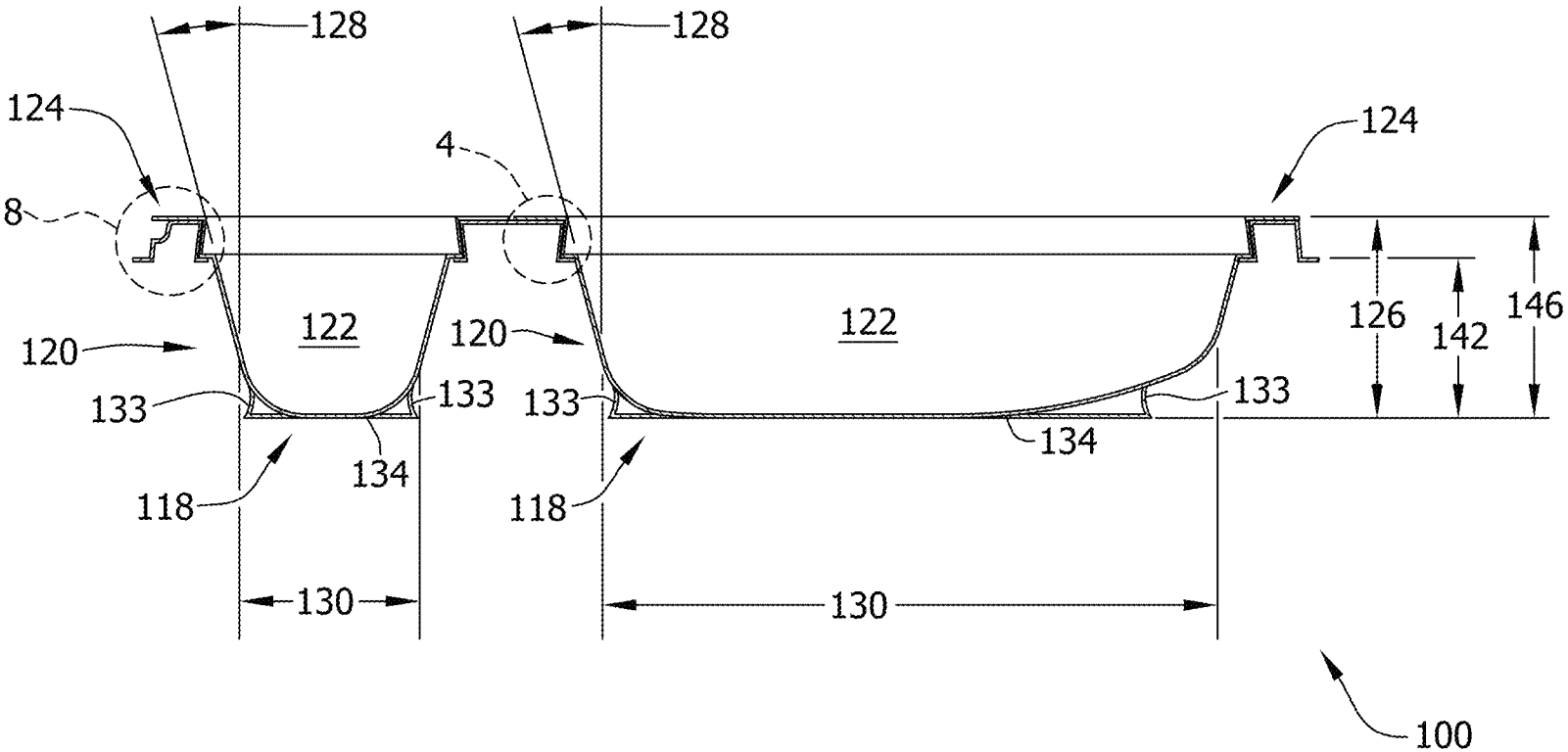
FIG. 3 is a cross-sectional view of the modular container assembly shown in FIG. 1.

FIGS. 1-3 illustrate an exemplary modular container assembly 100 for packaging a plurality of products (not shown). As shown in at least FIGS. 1 and 2, modular container assembly 100 includes a plurality of containers 102 and a frame 104 has a plurality of openings 106 defined therethrough (shown in FIG. 2). In the exemplary embodiment, each container 102 is suitably sized and configured to receive at least one product (not shown) of the plurality of products. In the exemplary embodiment, each opening 106 is suitably sized and configured to receive at least one container 102. Modular container assembly 100 facilitates maintaining a distance 108 between adjacent containers 102 when received within respective openings 106 to reduce a heat transfer between adjacent containers 102. In the exemplary embodiment, each container 102 is removably coupleable to frame 104 such that container 102 is portable relative to frame. It is understood that container 102 and/or opening 106 may have any suitable size and/or shape without departing from the scope of this invention.

Particularly, in the exemplary embodiment, each container 102 and each opening 102 are semielliptical in shape. More particularly, in the exemplary embodiment, plurality of containers 102 includes a first container 110 that is semielliptical in shape and a second container 112 that is semielliptical in shape, wherein first container 110 is smaller than second container 112. Moreover, in the exemplary embodiment, frame 104 includes a first opening 114 (shown in FIG. 2) that is sized and configured to receive first container 110 therein and a second opening 116 (shown in FIG. 2) that is sized and configured to receive second container 112 therein. First container 110 and second container 112 are described generally herein as container 102, and first opening 114 and second opening 116 are described generally herein as opening 106.

As shown in at least FIG. 3, container 102 includes a base 118 and a sidewall 120 that extends about base 118 to define a cavity 122. In the exemplary embodiment, sidewall 120 extends upwardly between base 118 and a rim portion 124 to have a height 126 of less than approximately 5.0 inches (in.). Particularly, in the exemplary embodiment, height 126 is between approximately 0.5 in. and approximately 1.7 in. Height 126 may be any height that enables container 102 to function as described herein.

Moreover, in the exemplary embodiment, sidewall 120 extends upwardly from base 118 at an angle 128 that is within approximately 60° from perpendicular. Particularly, in the exemplary embodiment, angle 128 is within approximately 30° from perpendicular. Angle 128 may be any angle that enables container 102 to function as described herein.

In the exemplary embodiment, base 118 has a length 130 and a width 132 (shown in FIGS. 1 and 2) that facilitate stabilizing container 102 when positioned upright. In one embodiment, base 118 includes at least one foot 133 (shown in FIG. 3) configured and/or oriented to maintain container 102 in an upright position. In the exemplary embodiment, length 130 and/or width 132 are less than approximately 5.0 in. Particularly, in the exemplary embodiment, length 130 is between approximately 0.8 in. and approximately 4.2 in, and width 132 is between approximately 1.9 in. and approximately 4.2 in. Length 130 and/or width 132 may be any size that enables container 102 to function as described herein.

Moreover, in the exemplary embodiment, base 118 has a bottom surface 134 that is substantially flat to facilitate stabilizing container 102 when positioned on bottom surface 134. In the exemplary embodiment, at least a portion of bottom surface 134 is textured to facilitate increasing traction between bottom surface 134 and a surface (not shown) on which container 102 is positioned. In the exemplary embodiment, the texturing may be formed integrally with bottom surface 134 and/or are applied to bottom surface 134. In the exemplary embodiment, the texturing includes grooves, bumps, knurling, dimples, and/or particulate material that are formed integrally with bottom surface 134 and/or are applied to bottom surface 134. In one embodiment, the texturing may be formed integrally and/or applied to any other surface of base 118 and/or sidewall 120.

Figure 4:
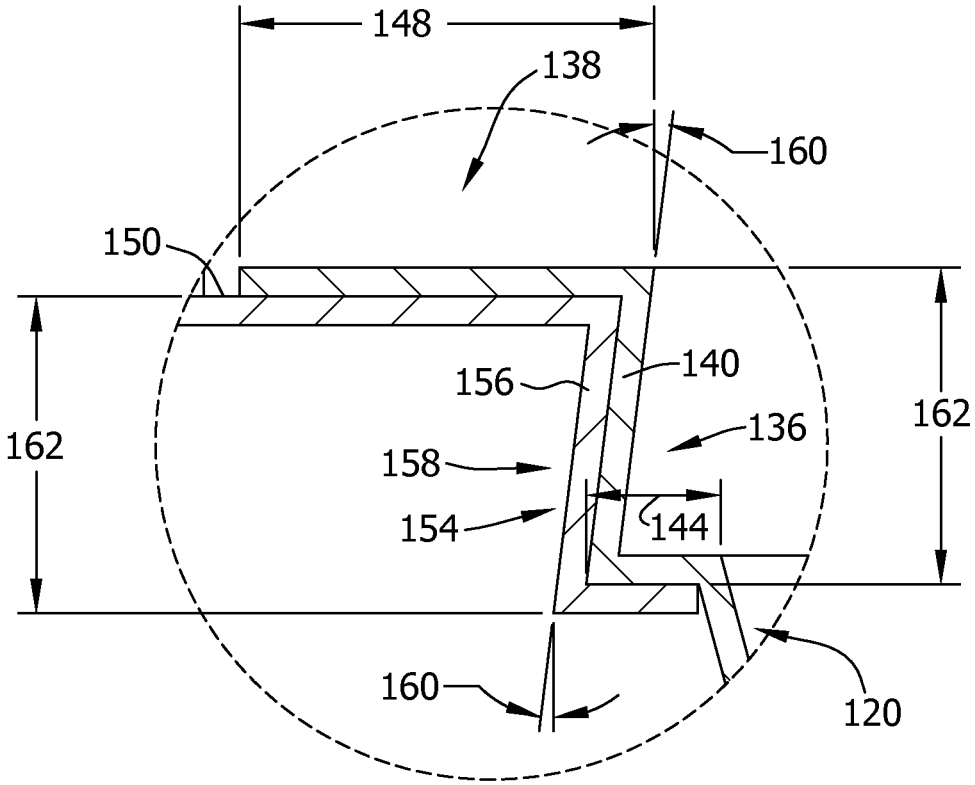
FIGS. 4-8 are detailed cross-sectional views of exemplary flange-undercut interfaces.

As shown in at least FIG. 4, at least a segment of rim portion 124 includes a first flange 136 and/or a second flange 138. In the exemplary embodiment, first flange 136 and/or second flange 138 facilitate removably coupling container 102 to frame 104.

In the exemplary embodiment, first flange 136 extends about at least a portion of cavity 122. More particularly, in the exemplary embodiment, first flange 136 extends about a perimeter of rim portion 124. Alternatively, a plurality of first flanges 136 may extend intermittently about the perimeter of rim portion 124. In the exemplary embodiment, first flange 136 includes a container back drafted wall 140, described in further detail below.

In the exemplary embodiment, first flange 136 is positioned at a first height 142 (shown in FIG. 3) above base 118. In the exemplary embodiment, first height 142 is less than approximately 2.4 in. Particularly, in the exemplary embodiment, first height 142 is between approximately 0.5 in. and approximately 1.6 in. First height 142 may be any height that enables container 102 to function as described herein.

Moreover, in the exemplary embodiment, first flange 136 extends outwardly a first distance 144 from sidewall 120. In the exemplary embodiment, first distance 144 is less than approximately 0.3 in. Particularly, in the exemplary embodiment, first distance 144 is less than approximately 0.2 in. First distance 144 may be any distance that enables container 102 to function as described herein.

In the exemplary embodiment, second flange 138 extends about at least a portion of cavity 122. More particularly, in the exemplary embodiment, second flange 138 extends about the perimeter of rim portion 124. Alternatively, a plurality of second flanges 138 may extend intermittently about the perimeter of rim portion 124.

In the exemplary embodiment, second flange 136 is positioned at a second height 146 (shown in FIG. 3) above base 118 that is greater than first height 142. In the exemplary embodiment, second height 146 is less than approximately 2.5 in. Particularly, in the exemplary embodiment, second height 146 is between approximately 0.6 in. and approximately 1.7 in. Second height 146 may be any height that enables container 102 to function as described herein. Second height 146 is typically similar to height 126 of sidewall 120.

Moreover, in the exemplary embodiment, second flange 138 extends outwardly a second distance 148 from sidewall 120 that is greater than first distance 144. In the exemplary embodiment, second distance 148 is less than approximately 0.6 in. Particularly, in the exemplary embodiment, second distance 148 is between approximately 0.2 in. and approximately 0.4 in. Second distance 148 may be any distance that enables container 102 to function as described herein. In the exemplary embodiment, second flange 138 enables positioning at least a segment of rim portion 124 above at least a portion of frame 104.

In the exemplary embodiment, container 102 is coverable with a lid (not shown). More specifically, in the exemplary embodiment, the lid is releasably coupleable to container 102 for positioning the lid relative to container 102 between an open configuration and a closed configuration of container 102. In the open configuration, the lid is at least partially removed from container 102 to provide access to cavity 122. In the closed configuration, the lid is coupled to container 102 to substantially enclose cavity 122.

In the exemplary embodiment, frame 104 includes a top surface 150 including a frame edge portion 152 (shown in FIG. 2) that defines opening 106. In the exemplary embodiment, at least a segment of frame edge portion 152 includes an undercut 154, or a notch, that is configured to engage with first flange 136 to facilitate removably coupling container 102 to frame 104. In the exemplary embodiment, undercut 154 is substantially complementary to first flange 136. More specifically, in the exemplary embodiment, undercut 154 includes a frame back drafted wall 156 that is substantially complementary to container back drafted wall 140 of first flange 136.

A resistance of separation is associated with an interface 158 between first flange 136 and undercut 154. More specifically, the resistance of separation is associated with an amount of force required to couple container 102 to frame 104 and/or decouple container 102 from frame 104. For example, increasing the resistance of separation associated with interface 158 generally requires additional force to couple container 102 to frame 104 and/or decouple container 102 from frame 104. Conversely, decreasing the resistance of separation associated with interface 158 generally requires less force to couple container 102 to frame 104 and/or decouple container 102 from frame 104.

In the exemplary embodiment, the resistance of separation is controlled by adjusting interface 158. In the exemplary embodiment, the resistance of separation is controlled by adjusting a configuration of container back drafted wall 140 and/or frame back drafted wall 156. More specifically, in the exemplary embodiment, a back draft angle 160, a height 162, and/or a lock feature radius 164 (shown in at least FIG. 5) of container back drafted wall 140 and/or frame back drafted wall 156 is adjusted to control the resistance of separation between container 102 and frame 104. Moreover, in the exemplary embodiment, a gap or distance 166 (shown in at least FIG. 5) between container back drafted wall 140 and frame back drafted wall 156 is adjusted to control the resistance of separation between container 102 and frame 104.

In the exemplary embodiment, modular container assembly 100 includes containers 102 having varying configurations including back draft angles 160, heights 162, and/or lock feature radii 164, wherein each container 102 has a respective resistance of separation associated with its particular configuration. Moreover, in the exemplary embodiment, modular container assembly 100 includes a plurality of frames 104 having varying configurations including back draft angles 160, heights 162, and/or lock feature radii 164, wherein each frame 104 has a respective resistance of separation associated with its particular configuration.

In the exemplary embodiment, container 102 and/or frame 104 include any combination of first flanges 136 and/or undercuts 154 shown in FIGS. 4-7 to control the resistance of separation between container 102 and frame 104. For example, back draft angle 160 and/or height 162 may be increased to facilitate increasing the resistance of separation between container 102 and frame 104. Conversely, back draft angle 160 and/or height 162 may be decreased to facilitate decreasing the resistance of separation between container 102 and frame 104. In the exemplary embodiment, providing container back drafted wall 140 and/or frame back drafted wall 156 with a lock feature radius 164 may facilitate decreasing the resistance of separation between container 102 and frame 104. Moreover, in the exemplary embodiment, increasing distance 166 between container back drafted wall 140 and frame back drafted wall 156 may facilitate decreasing the resistance of separation between container 102 and frame 104.

Figure 5:
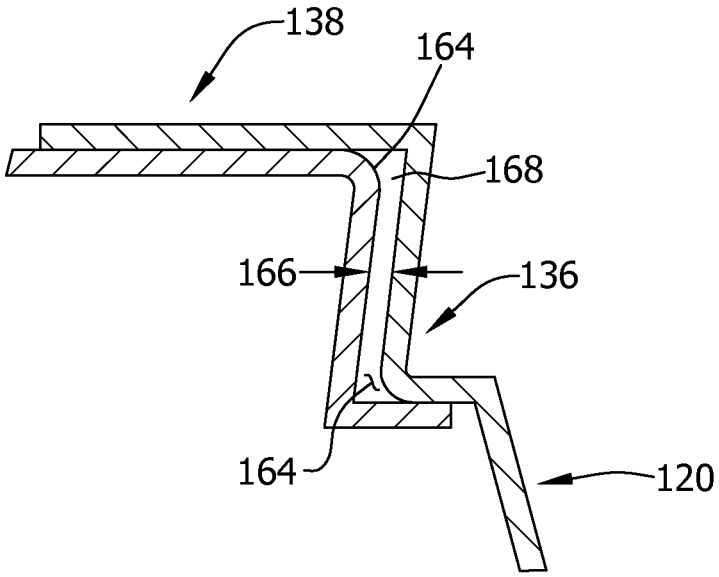
Figure 6:
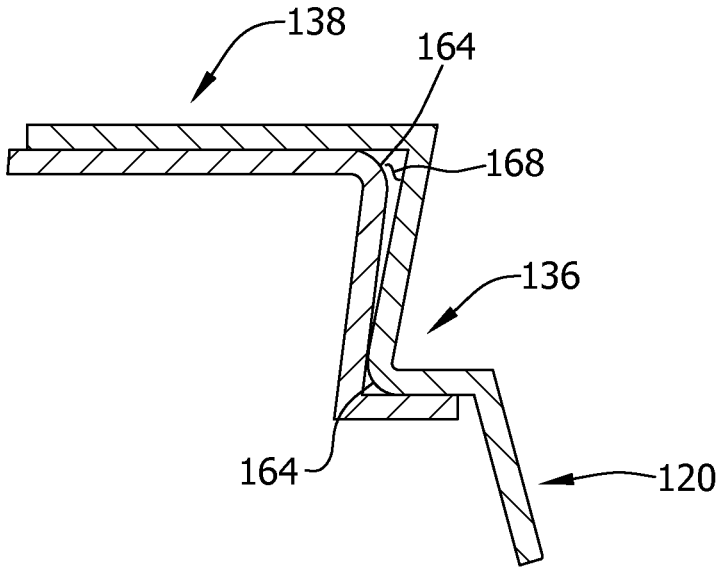
Figure 7:
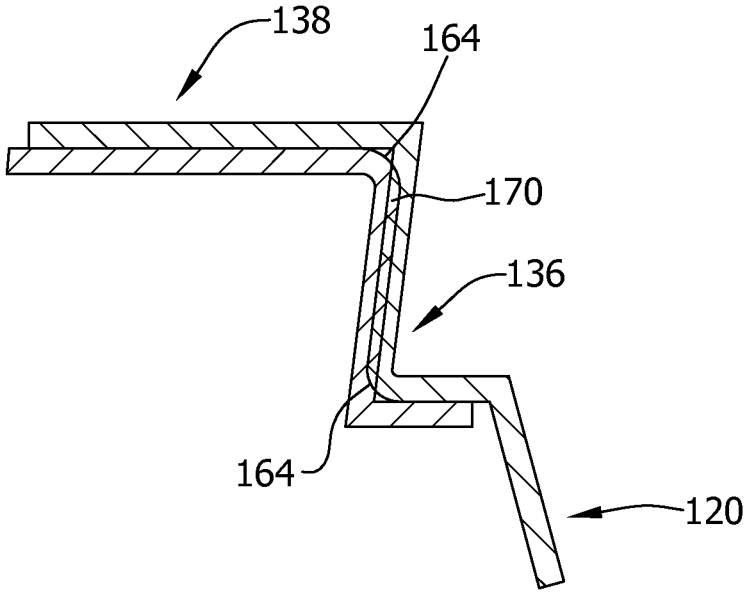

Particularly, as shown in FIG. 4, first flange 136 is configured to align substantially flush with undercut 154 when container 102 is coupled to frame 104. Moreover, as shown in FIG. 5, first flange 136 and undercut 154 have substantially complementary configurations, but distance 166 is provided between container back drafted wall 140 and frame back drafted wall 156 when container 102 is coupled to frame 104. Further, as shown in FIG. 6, first flange 136 and undercut 154 have varying back draft angles 160 such that a gap 168 is provided between container back drafted wall 140 and frame back drafted wall 156 when container 102 is coupled to frame 104. Furthermore, as shown in FIG. 7, first flange 136 and undercut 154 have substantially complementary configurations, but an interference fit 170 is provided between container back drafted wall 140 and frame back drafted wall 156 when container 102 is coupled to frame 104.

Figure 8:
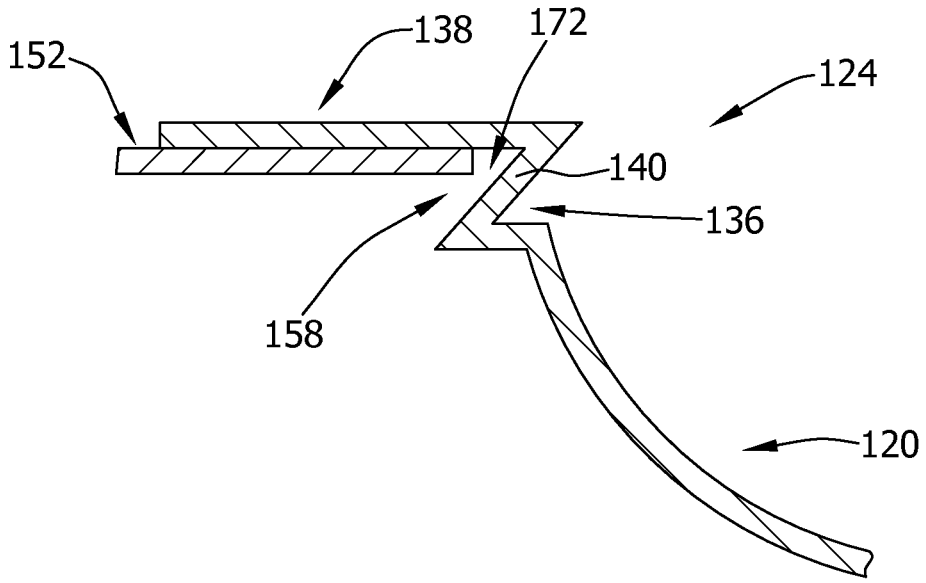

FIG. 8 illustrates an alternative flange-undercut interface 158. In the exemplary embodiment, at least a segment of rim portion 124 includes first flange 136 and/or second flange 138. In the exemplary embodiment, first flange 136 includes container back drafted wall 140, and second flange 138 extends outwardly to define an undercut 172 therebelow. In the exemplary embodiment, at least a segment of frame edge portion 152 is sized and/or configured to fit within undercut 172 to facilitate removably coupling container 102 to frame 104.

Figure 9:
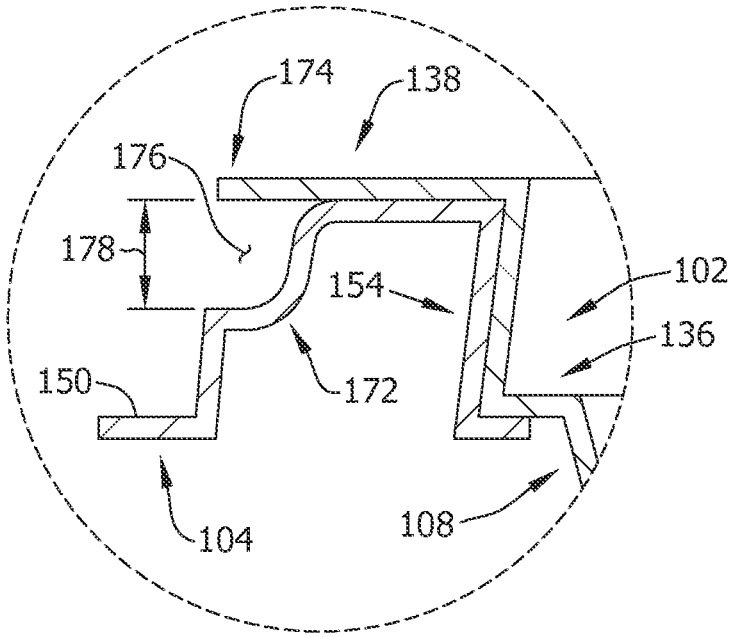
FIG. 9 is a detailed cross-sectional view of an exemplary flange-step interface.

As shown in at least FIG. 9, at least a portion of top surface 150 includes a step 172 to facilitate decoupling container 102 from frame 104. In the exemplary embodiment, step 172 extends about at least a portion of opening 106. More particularly, in the exemplary embodiment, step 172 extends about a perimeter of opening 106. Alternatively, step 172 may extend intermittently about the perimeter of opening 106.

Particularly, in the exemplary embodiment, at least a portion of second flange 138 extends over at least a portion of step 172 to provide an overhang 174 such that a gap 176 is formed between second flange 138 and step 172 when container 102 is coupled to frame 104. In the exemplary embodiment, a size of gap 176 is controlled by adjusting height 162 of container back drafted wall 140, height 162 of frame back draft wall 156 and/or a depth 178 of step 172 relative to top surface 150.

In the exemplary embodiment, container 102 and/or frame 104 are fabricated from at least one suitable material including, without limitation, polyethylene terephthalate (PET), high-impact polystyrene (HIP), polypropylene (PP), copolymer polypropylene (COPP), polyvinyl chloride (PVC), oriented polystyrene (OPS), a copolyester (PETG), and/or an acrylonitrile (BAREX). Notably, each individual container 102 and/or frame 104 may be produced from any material or combination of materials that are suitable for the container contents, processing requirements, and/or storage requirements. For example, in one embodiment, containers 102 are decoupled from frame 104, such that containers 102 may be sorted based on a recyclability of the material and/or combination of materials used to fabricate each container 102. Moreover, in such an embodiment, containers 102 and/or frame 104 may be selected for use based on a recyclability of the material and/or combination of materials used to fabricate containers 102 and/or frame 104.

In one embodiment, container 102 and/or frame 104 includes a hang tab 180 (shown in FIG. 2) configured to cooperate with a shelf display peg, a butterfly hook, a wire peg hook, and/or a merchandising strip, such that container 102 and/or frame 104 is displayable in a display environment. In such an embodiment, the hang tab includes an opening and/or a hook sized and/or oriented to receive the shelf display peg, butterfly hook, wire peg hook, and/or merchandising strip.

In one embodiment, container 102 and/or frame 104 may be formed in an injection molding and/or thermoforming process used for producing parts from thermoplastic or thermosetting plastic materials. Particularly, at least one suitable material may be selected to fabricate container 102 depending on a product retained within cavity 122, processing needs for the product, a barrier requirement, and/or a shelf stabilization requirement. It is understood, however, that container 102 and/or frame 104 may be constructed of different materials from each other without departing from the scope of this invention.

Figure 10:
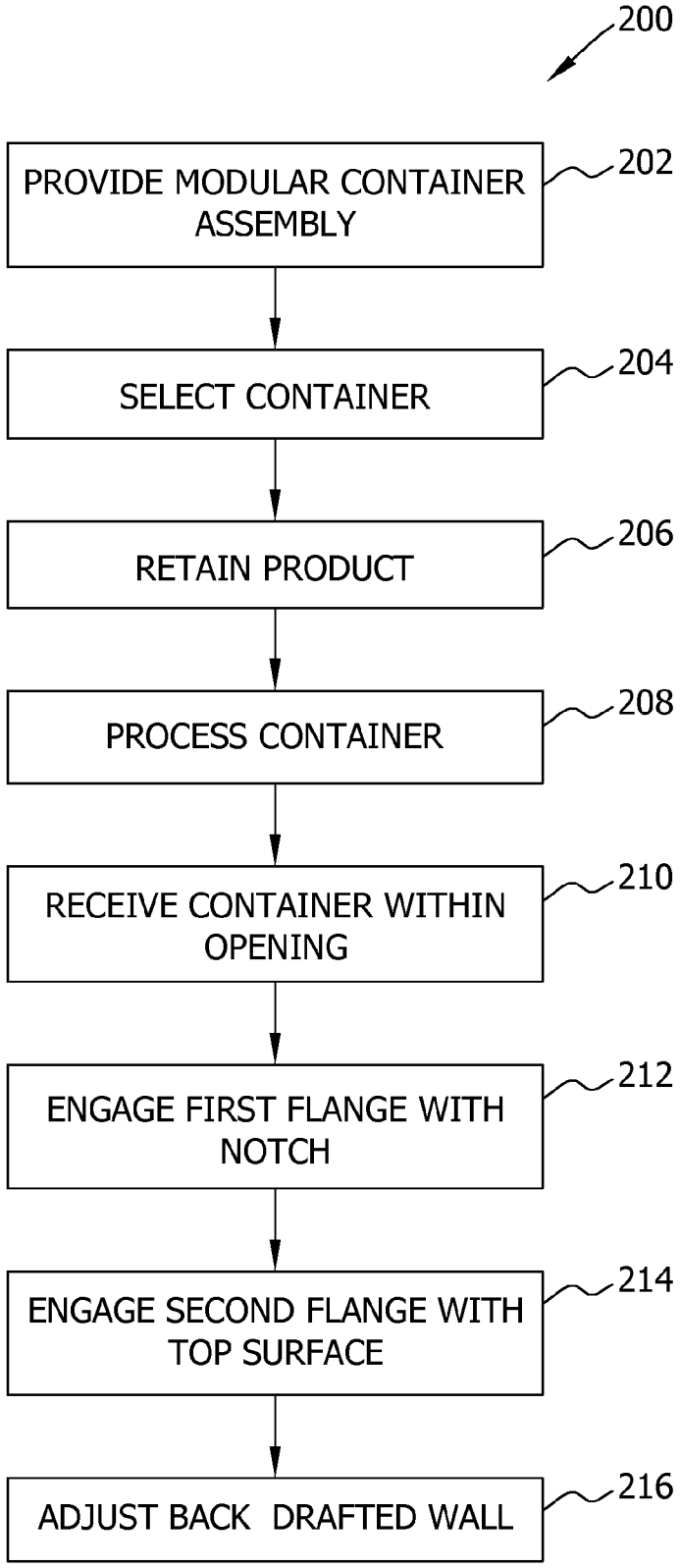
FIG. 10 is a flow chart illustrating an exemplary method for packaging a plurality of products using the modular container assembly shown in FIG. 1.

FIG. 10 illustrates a method 200 for packaging a plurality of products (not shown) using modular container assembly 100. During operation, in the exemplary embodiment, modular container assembly 100 is provided 202.

In the exemplary embodiment, each container 102 is selected 204 based on the product retained within cavity 122, the material used to fabricate container 102, a desired processing of the product, and/or a desired resistance of separation between container 102 and frame 104.

In the exemplary embodiment, container 102 retains 206 at least one product within cavity 122 independent of the other containers 102. Moreover, in the exemplary embodiment, container 102 is processed 208 independent of the other containers 102. More specifically, in the exemplary embodiment, container 102 is processed to process product retained within cavity 122. In the exemplary embodiment, processing includes at least partially filling cavity 122 with at least one product, heating container 102, cooling container 102, sealing container 102, and/or storing container 102.

In the exemplary embodiment, container 102 is removably coupled to frame 104 independent of the other containers 102. More specifically, in the exemplary embodiment, container 102 is received 210 within opening 106 such that first flange 136 engages 212 with undercut 154. Moreover, in the exemplary embodiment, second flange 138 engages 214 with top surface 150 such that second flange 138 extends above step 172 to provide gap 176 therebetween. In the exemplary embodiment, second flange 138 facilitates sealing distance 166 and/or gap 168 disposed between container back drafted wall 140 and frame back drafted wall 156.

In the exemplary embodiment, container back drafted wall 140 and/or frame back drafted wall 156 are adjusted 216 to align container back drafted wall 140 substantially flush with frame back drafted wall 156, provide distance 166 between container back drafted wall 140 and frame back drafted wall 156, provide gap 168 between container back drafted wall 140 and frame back drafted wall 156, and/or provide interference fit 170 between container back drafted wall 140 and/or frame back drafted wall 156.

In the exemplary embodiment, modular container assembly 100 enables coupling any suitable combination of containers 102 to frame 104 and/or decoupling any suitable combination of containers 102 from frame 104. When container 102 is coupled to frame 104, modular container assembly 100 acts as a single unit. Conversely, when container 102 is decoupled from frame 104, modular container assembly 100 acts as a plurality of units. In the exemplary embodiment, any combination of containers 102 and/or frames 104 may be provided based on, for example, a processing requirement for each product retained within each cavity 122.

Figure 11:
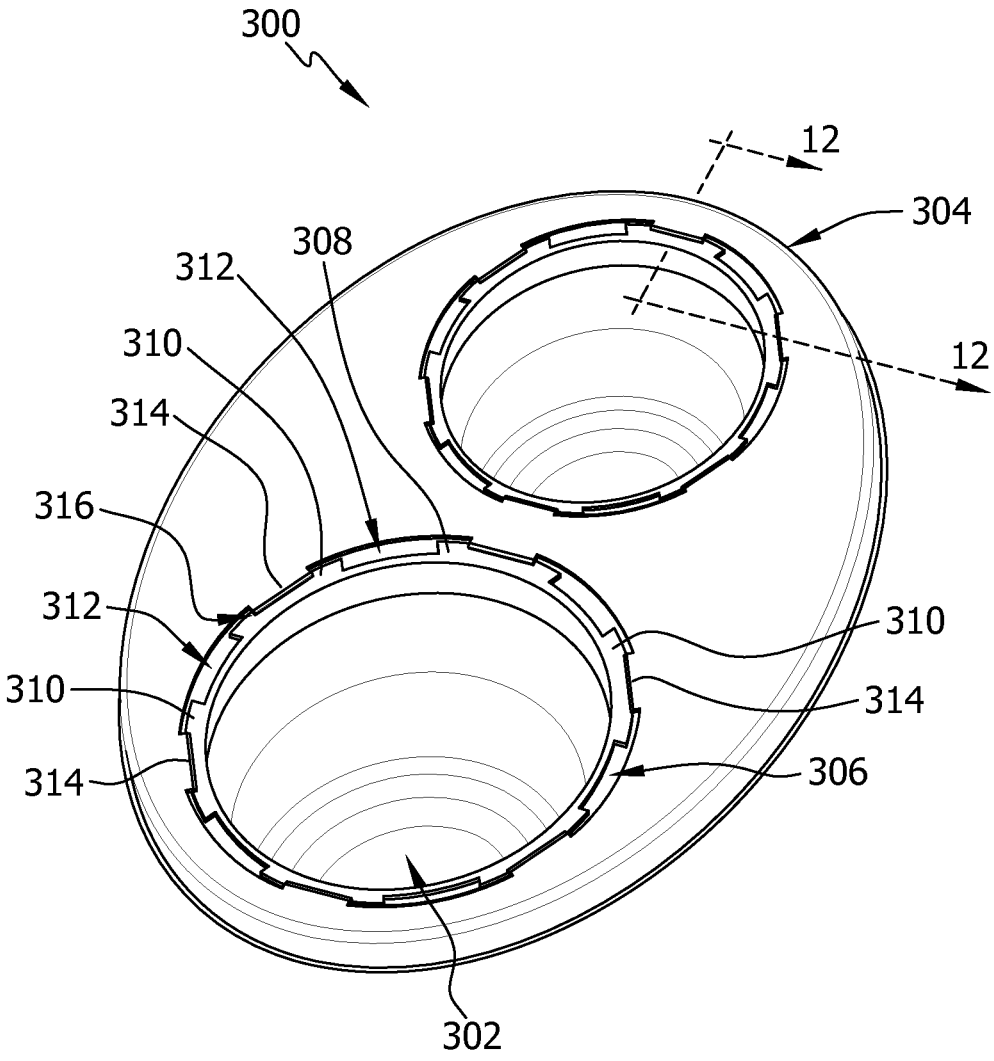
FIG. 11 is a perspective view of another exemplary modular container assembly.

FIG. 11 illustrates another exemplary modular container assembly 300 for packaging a plurality of products (not shown). In the exemplary embodiment, modular container assembly 300 includes a plurality of containers 302 and a frame 304 including a plurality of openings 306 defined therethrough. In the exemplary embodiment, each container 302 is suitably sized and configured to receive at least one product (not shown) of the plurality of products. In the exemplary embodiment, each opening 306 is suitably sized and configured to receive at least one container 302.

Figure 12:
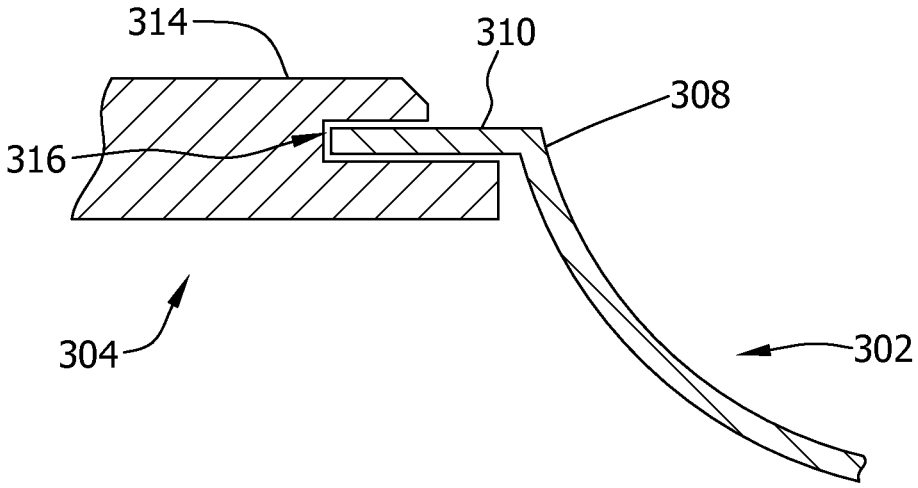
FIG. 12 is a detailed cross-sectional view of an exemplary flange-undercut interface.

As shown in FIGS. 11 and 12, container 302 is removably coupleable to frame 304 using a moving tool flange-undercut interface. In the exemplary embodiment, a rim portion 308 of container 302 includes a plurality of first flanges 310 that extend intermittently about a perimeter of rim portion 308 to define a plurality of flange recesses 312 between adjacent first flanges 310. In the exemplary embodiment, frame 304 includes a plurality of second flanges 314 that extend intermittently about a perimeter of opening 306. In the exemplary embodiment, second flanges 314 are spaced, sized, and/or oriented to fit within flange recesses 312. Moreover, in the exemplary embodiment, each second flange 314 defines an undercut 316 that is sized and/or configured to receive at least a portion of first flange 310 therein.

During use, in the exemplary embodiment, container 302 is movable between a locked configuration and a loading configuration. In the locked configuration, container 302 is oriented relative to frame 304 such that at least a portion of first flange 310 is substantially aligned with second flange 314. As such, in the locked configuration, at least a portion of first flange 310 is positioned within undercut 316. In the loading configuration, container 302 is oriented relative to frame 304 such that flange recess 312 is substantially aligned with second flange 314. In one embodiment, a container lid (not shown) facilitates moving container 302 between the locked configuration and the loading configuration.

Exemplary embodiments of methods and systems are described and/or illustrated herein in detail. The exemplary methods and systems facilitate customizing the processing of products. As such, the methods and systems described herein facilitate reducing the costs associated with processing the products, reducing the time required to process the products, increasing a capacity of a processing line, and increasing the flexibility for customer usage. Moreover, the methods and systems described herein facilitate reducing an exposure of a container to undesired processing, thus enabling combining a greater quantity and/or variety of differently processed bowls. The exemplary systems and methods are not limited to the specific embodiments described herein, but rather, components of each system and/or steps of each method may be utilized independently and separately from other components and/or method steps described herein. Each component and each method step may also be used in combination with other components and/or method steps.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A modular container assembly comprising:

a frame comprising a plurality of edge portions that define a plurality of openings, wherein a first edge portion of said plurality of edge portions comprises an undercut and a step; and a first portable container comprising a sidewall that defines a cavity, said first container sealable at a rim portion of said sidewall to retain a product within the cavity, said first container configured to fit within a first opening of the plurality of openings such that said rim portion is removably coupled to said first edge portion of said plurality of edge portions, said rim portion comprising a first flange that is substantially complementary to said undercut and a second flange that extends over said step when said rim portion is coupled to said first edge portion.

2. A modular container assembly in accordance with claim 1, wherein, when said rim portion is coupled to said first edge portion, said first flange is one of aligned substantially flush with said undercut, aligned to define a gap between said first flange and said undercut, and aligned to provide an interference fit between said first flange and said undercut.

3. A modular container assembly in accordance with claim 1, wherein said first container is fabricated from a first material having a first recyclability, and said frame is fabricated at least partially from a second material having a second recyclability.

4. A modular container assembly in accordance with claim 1 further comprising a second portable container comprising a second rim portion, said second container configured to fit within a second opening of the plurality of openings such that said second rim portion is removably coupled to a second edge portion of said plurality of edge portions.

5. A modular container assembly in accordance with claim 4, wherein said first edge portion has a first configuration, and said second edge portion has a second configuration different from said first configuration.

6. A modular container assembly in accordance with claim 1 further comprising a second container, wherein said first container has a first configuration, and said second container has a second configuration different from said first configuration.

7. A modular container assembly in accordance with claim 1 further comprising a second container, wherein said first container is fabricated from a first material having a first recyclability, and said second container is fabricated at least partially from a second material having a second recyclability.

8. A modular container assembly in accordance with claim 1, wherein said first container comprises at least one of a foot and a hang tab.

9. A method for packaging a product in a modular container assembly that includes a frame and a first portable container, the frame including a plurality of edge portions that define a plurality of openings, wherein a first edge portion of the plurality of edge portions includes an undercut and a step, the first container including a sidewall that defines a cavity, the sidewall including a rim portion, wherein the rim portion includes a first flange that is substantially complementary to the undercut and a second flange, said method comprising:

at least partially filling the first container with the product;

sealing the container at the rim portion to retain the product within the cavity;

receiving the first container within a first opening of the plurality of openings; and removably coupling the rim portion to the first edge portion of the plurality of edge portions, such that the first flange interfaces with the undercut and the second flange extends over the step.

10. A method in accordance with claim 9 further comprising:

determining a material used to fabricate the frame; and selecting the first container based at least partially on the material used to fabricate the frame.

11. A method in accordance with claim 9 further comprising:

receiving a second portable container within a second opening of the plurality of openings, the second container including a second rim portion; and removably coupling the second rim portion to a second edge portion of the plurality of edge portions.

12. A method in accordance with claim 11 further comprising:

determining a configuration of the first container; and selecting the second container based at least partially on the configuration of the first container.

13. A method in accordance with claim 11 further comprising:

determining a material used to fabricate the first container; and selecting the second container based at least partially on the material of the first container.

14. A portable container for use with a modular container assembly including a frame that includes a plurality of edge portions that define a plurality of openings, wherein a first edge portion of said plurality of edge portions includes an undercut, said container comprising:

a base; and a sidewall extending upward from said base to define a cavity, said container is sealable at a rim portion of said sidewall to retain a product within the cavity, said container configured to fit within a first opening of the plurality of openings such that said rim portion is removably coupled to the first edge portion of the plurality of edge portions, said rim portion comprising a first flange that is substantially complementary to an undercut of the first edge portion and a second flange that extends over a step of the first edge portion when said container is coupled to the frame.

15. A portable container in accordance with claim 14, wherein said container is fabricated at least partially from a first material having a first recyclability, and the frame is fabricated at least partially from a second material having a second recyclability.

16. A portable container in accordance with claim 14 further comprising at least one of a foot and a hang tab.

* * * * *